US012116673B2

(12) United States Patent
Diez et al.

(10) Patent No.: US 12,116,673 B2
(45) Date of Patent: Oct. 15, 2024

(54) ZnAlMg-COATED METAL SHEET WITH IMPROVED FLEXIBILITY AND CORRESPONDING MANUFACTURING PROCESS

(71) Applicant: ArcelorMittal, Luxembourg (LU)

(72) Inventors: Luc Diez, Maizieres les Mets (FR); Clémence Filou, Grivegnee (BE); Gunhild Föjer, Destelbergen (BE); Manel Ben Saad, La Garenne Colombes (FR)

(73) Assignee: ArcelorMittal, Luxembourg (LU)

( * ) Notice: Subject to any disclaimer, the term of this patent is extended or adjusted under 35 U.S.C. 154(b) by 17 days.

(21) Appl. No.: 17/347,868

(22) Filed: Jun. 15, 2021

(65) Prior Publication Data

US 2021/0310129 A1 Oct. 7, 2021

Related U.S. Application Data

(63) Continuation of application No. 15/028,249, filed as application No. PCT/IB2014/002059 on Oct. 9, 2014, now abandoned.

(30) Foreign Application Priority Data

Oct. 9, 2013 (WO) ..... PCT/IB2013/002239

(51) Int. Cl.

| | |
|---|---|
| ***C23C 2/06*** | (2006.01) |
| ***C23C 2/26*** | (2006.01) |
| ***C23C 2/36*** | (2006.01) |
| ***C23C 22/34*** | (2006.01) |
| ***C23C 22/78*** | (2006.01) |
| ***C23C 22/82*** | (2006.01) |

(52) U.S. Cl.

CPC ..... *C23C 22/78* (2013.01); *C23C 2/06* (2013.01); *C23C 2/26* (2013.01); *C23C 2/36* (2013.01); *C23C 22/34* (2013.01); *C23C 22/82* (2013.01)

(58) Field of Classification Search

None

See application file for complete search history.

(56) References Cited

U.S. PATENT DOCUMENTS

| | | | | |
|---|---|---|---|---|
| 4,291,074 | A * | 9/1981 | Schoeps | C23C 2/0062 427/349 |
| 5,059,455 | A * | 10/1991 | Hasselbach | C23C 2/02 427/292 |
| 5,578,669 | A * | 11/1996 | Odawa | C09D 167/08 524/591 |
| 8,962,153 | B2 | 2/2015 | Koumura et al. | |
| 9,914,992 | B2 | 3/2018 | Dietz et al. | |
| 2003/0012959 | A1* | 1/2003 | Doty | C09D 175/04 428/423.1 |
| 2007/0227842 | A1* | 10/2007 | Idei | F16D 69/04 188/251 M |
| 2008/0280046 | A1* | 11/2008 | Bryden | C23C 22/73 427/327 |
| 2009/0011274 | A1 | 1/2009 | Ogata et al. | |
| 2010/0035080 | A1 | 2/2010 | Sigler et al. | |
| 2010/0055344 | A1* | 3/2010 | Ostwald | C23C 2/06 427/321 |
| 2010/0233469 | A1* | 9/2010 | Sasaki | C08G 18/6662 428/327 |
| 2011/0111255 | A1 | 5/2011 | Diez et al. | |
| 2012/0052206 | A1* | 3/2012 | Diez | C23C 2/06 118/58 |

FOREIGN PATENT DOCUMENTS

| | | | | |
|---|---|---|---|---|
| AU | 2012263323 | B2 | 7/2015 | |
| CA | 2809940 | A1 * | 3/2012 | C08G 18/0819 |
| EP | 1199376 | A1 * | 4/2002 | C23C 2/02 |
| EP | 2088219 | | 8/2009 | |
| JP | S58177447 | | 10/1983 | |
| JP | H11158657 | | 6/1999 | |
| JP | 2001020049 | | 1/2001 | |
| JP | 2002212699 | A * | 7/2002 | |
| JP | 2002285312 | A | 10/2002 | |
| JP | 2006328445 | | 12/2006 | |
| JP | 2008000910 | | 1/2008 | |
| JP | 2009113389 | | 5/2009 | |
| JP | 2009191317 | A | 8/2009 | |
| JP | 2010255084 | | 11/2010 | |
| KR | 20100118129 | | 11/2010 | |
| WO | WO2011009999 | A1 | 1/2011 | |
| WO | WO2012165644 | | 12/2012 | |

* cited by examiner

*Primary Examiner* — David P Turocy

(74) *Attorney, Agent, or Firm* — Davidson Kappel LLC

(57) ABSTRACT

A process for the manufacture of a pre-painted sheet. The process includes supplying a steel substrate, depositing a metallic coating on at least one face by hot-dipping of the substrate in a bath including 4.4% to 5.25% by weight aluminum and 0.3% to 0.56% by weight magnesium. The rest of the bath includes exclusively zinc, unavoidable impurities resulting from the process and optionally one or more additional elements including Si, Ti, Ca, Mn, La, Ce and Bi. The content by weight of each additional element in the metallic coating is less than 0.3% and the presence of nickel is excluded. The process further includes solidifying the metallic coating, surface preparation of the metallic coating and painting of the metallic coating. The present invention further provides a pre-painted sheet.

21 Claims, No Drawings

ZnAlMg-COATED METAL SHEET WITH IMPROVED FLEXIBILITY AND CORRESPONDING MANUFACTURING PROCESS

This is a continuation of U.S. patent application Ser. No. 15/028,249, filed Apr. 8, 2016, which is a National Phase of International Patent Application PCT/IB2014/002059, filed Oct. 9, 2014, which claims priority to International Patent Application PCT/IB2013/002239, filed on Oct. 9, 2013, all of which are hereby incorporated by reference herein.

This invention relates to a metal sheet comprising a substrate, at least one face of which is coated with a metallic coating comprising A1 and Mg, the remainder of the metallic coating being Zn, unavoidable impurities and optionally one or more additional elements selected from among Si, Ti, Ca, Mn, La, Ce and Bi, wherein the content by weight of each additional element in the metallic coating is less than 0.3%.

BACKGROUND

Galvanized metallic coatings comprising essentially zinc and 0.1 to 0.4% by weight aluminum are conventionally used because of the effective protection they provide against corrosion.

Coatings that are currently competitors with these metallic coatings comprise in particular zinc and additions of magnesium and aluminum, in proportions that can respectively be as high as up to 10% and up to 20% by weight.

Metallic coatings of this type are referred to overall in this application by the term zinc-aluminum-magnesium or ZnAlMg coatings.

The addition of magnesium significantly improves the corrosion resistance of steels coated with a metallic coating which can make it possible to reduce the thickness of the metallic coating or, with a constant thickness, to increase the guarantee of protection against corrosion over time.

These sheets coated with a ZnAlMg coating are intended, for example, for use in the automobile sector, electric household appliances or construction.

It is known that the addition of magnesium in metallic coatings causes a hardening of the coating, and that leads to the appearance of cracks in the thickness of the coating when the coated sheet is severely bent.

It is known from JP2010255084 that the cracking resistance can be improved by adding from 0.005 to 0.2% by weight nickel to a metallic coating that also contains 1 to 10% by weight aluminum and 0.2 to 1% by weight magnesium. The nickel thus added has the characteristic that the majority of the element is located at the interface between the steel and the metallic coating, which contributes to inhibiting the formation of cracks in the deformed zones. However, the addition of nickel has several disadvantages:

- the presence of nickel on the surface of the metallic coating accelerates contact corrosion,
- the increase in the number of elements in the bath makes the management of the bath much more complicated,
- the migration of the nickel to the steel/metallic coating interface is difficult to achieve and introduces additional fabrication constraints.

BRIEF SUMMARY OF THE INVENTION

An object of the present invention is to mitigate the problems mentioned above by making available a ZnAlMg sheet, the metallic coating of which cracks less on severe bends, while retaining the advantages of the ZnAlMg coating in terms of corrosion resistance.

The present invention provides a process for the manufacture of a pre-painted sheet comprising at least the following steps:

- supply of a steel substrate,
- deposition of a metallic coating on at least one face by hot-dipping of the substrate in a bath constituted by 4.4% to 5.6% by weight aluminum and 0.3% to 0.56% by weight magnesium, the remainder of the bath being exclusively zinc, unavoidable impurities resulting from the process and optionally one or more additional elements selected from the group consisting of Si, Ti, Ca, Mn, La, Ce and Bi, wherein the content by weight of each additional element in the metallic coating is less than 0.3%, wherein the presence of nickel is excluded,
- solidification of the metallic coating,
- surface preparation of the metallic coating, and
- painting of the metallic coating.

The process according to the present invention may also comprise the following optional characteristics, considered individually or in combination:

- the bath comprises from 4.75 to 5.25% by weight aluminum,
- the bath comprises from 0.44 to 0.56% by weight magnesium,
- the bath does not comprise any additional element,
- the bath is at a temperature between 370° C. and 470° C.,
- the metallic coating is solidified at a cooling rate greater than or equal to 15° C./s between the beginning of the solidification and the end of the solidification of the metallic coating,
- the cooling rate is between 15 and 35° C./s,
- the surface preparation comprises a step selected from among a rinsing, a degreasing and a conversion treatment,
- the degreasing is performed at a pH between 12 and 13,
- the conversion treatment is based on hexafluorotitanic acid,
- the painting of the metallic coating is performed by means of a paint having at least one polymer selected from the group consisting of melamine cross-linked polyesters, isocyanate cross-linked polyesters, polyurethanes and halogenated derivatives of vinyl polymers, with the exclusion of cataphoretic paints.

It will therefore be understood that the solution to the technical problem posed consists of combining a paint film and a metallic coating that have a particular composition. Surprisingly, it has been found by the inventors that this combination has a synergy such that the ZnAlMg coating according to the invention has fewer cracks in the severe bends when it is covered by a paint film than when it is bare.

The present invention further provides a pre-painted sheet comprising a steel substrate, at least one face of which is coated by a metallic coating constituted by 4.4% to 5.6% by weight aluminum and 0.3% to 0.56% by weight magnesium, the remainder of the metallic coating being exclusively zinc, unavoidable impurities resulting from the process and optionally one or more additional elements selected from the group consisting of Si, Ti, Ca, Mn, La, Ce and Bi, wherein the content by weight of each additional element in the metallic coating is less than 0.3%, wherein the presence of nickel in the metallic coating is excluded and the metallic coating is covered by at least one paint film.

The sheet according to the present invention can also have the following optional characteristics, considered individually or in combination:

the metallic coating comprises from 4.75 to 5.25% by weight aluminum, the metallic coating comprises from 0.44 to 0.56% by weight magnesium, the metallic coating does not comprise any additional element, the paint film comprises at least one polymer selected from the group consisting of melamine cross-linked polyesters, isocyanate cross-linked polyesters, polyurethanes and halogenated derivatives of vinyl polymers, to the exclusion of cataphoretic paints, a conversion layer comprising titanium is located at the interface between the metallic coating and the paint film.

Other characteristics and advantages of the invention will become apparent from a reading of the following description.

DETAILED DESCRIPTION

The invention will be better understood from a reading of the following description, which is provided by way of a non-restrictive explanation.

The sheet comprises a steel substrate covered on at least one of its faces with a metallic coating, which is itself covered by at least one paint film.

The metallic coating generally has a thickness less than or equal to 25 μm and has the purpose of protecting the substrate against corrosion.

The metallic coating is constituted by aluminum and magnesium, the remainder of the metallic coating being exclusively zinc, unavoidable impurities resulting from the metallic coating deposition process and optionally one or more additional elements selected among Si, Ti, Ca, Mn, La, Ce and Bi, wherein the percentage by weight of each additional element in the metallic coating is less than 0.3%, wherein the presence of nickel is excluded.

The content by weight of aluminum in the metallic coating is between 4.4 and 5.6%. This range of content by weight of aluminum promotes the formation of the binary eutectic Zn/Al in the microstructure of the metallic coating. This eutectic system is particularly ductile and promotes the achievement of a flexible metallic coating.

The aluminum content is preferably between 4.75 and 5.25% by weight.

It should be noted here that the content of aluminum by weight is measured without taking into account the intermetallic that is rich in aluminum and is located at the interface of the substrate and the metallic coating. A measurement of this type can be taken, for example, by glow discharge spectrometry. A measurement by chemical dissolution would lead to the simultaneous dissolution of the metallic coating and the intermetallic and would overestimate the content by weight of aluminum on the order of 0.05 to 0.5% as a function of the thickness of the metallic coating.

The content by weight of magnesium in the metallic coating is between 0.3 and 0.56%. Below 0.3%, the improvement in the resistance to corrosion provided by the magnesium is no longer sufficient. Above 0.56%, the synergy of the paint film and of the metallic coating according to the invention is no longer observed.

Preferably, the content by weight of magnesium is between 0.44 and 0.56%, which is the best compromise in terms of corrosion resistance and flexibility.

The unavoidable impurities originate from the ingots used to feed the molten zinc bath or result from the passage of the substrate in the bath. The most common unavoidable impurity that results from the passage of the substrate in the bath is iron, which can be present in an amount up to 0.8% by weight of the metallic coating, generally less than or equal to 0.4% and generally between 0.1 and 0.4% by weight.

The unavoidable impurities originating from the ingots used to feed the bath are generally lead (Pb), which is present in a content less than 0.01% by weight, cadmium (Cd), which is present in a content less than 0.005% by weight, and tin (Sn), which is present in a content less than 0.001% by weight. It should be noted here that nickel is not an unavoidable impurity resulting from the galvanization process.

The different additional elements can make it possible, among other things, to improve the ductility or the adhesion of the metallic coating to the substrate. A person skilled in the art who is familiar with their effects on the characteristics of the metallic coatings will know how to employ them, depending on the additional purpose sought. In the framework of the invention, the metallic coating does not include nickel as an additional element, because nickel has the disadvantages described above. Preferably, the metallic coating does not contain any additional element. That makes it possible to simplify the management of the galvanizing bath and to minimize the number of phases formed in the metallic coating.

Finally, the sheet comprises a paint film.

The paint films are generally polymer-based and comprise at least one layer of paint. They preferably comprise at least one polymer selected from the group consisting of melamine cross-linked polyesters, isocyanate cross-linked polyesters, polyurethanes and halogenated derivatives of vinyl polymers, with the exclusion of cataphoretic paints. These polymers have the characteristic that they are particularly flexible, which promotes the synergy of the paint film with the metallic coating.

The paint film can be formed, for example, by two successive layers of paints, namely a primer layer and a finish layer, which is generally the case in creating the film applied to the top face of the sheet, or a single layer of paint, which is generally the case in creating the film applied to the bottom face of the sheet. Other numbers of layers can be used in certain variants.

The paint films typically have thicknesses between 1 and 200 μm.

Optionally, the interface between the metallic coating and the paint film comprises one or more characteristics selected among an alteration of the aluminum oxide/hydroxide layer naturally present on the surface of the metallic coating, an alteration of the magnesium oxide/hydroxide layer naturally present on the surface of the metallic coating and a conversion layer characterized by its chromium layer weight (in the case of chromate conversion treatment) or by its titanium layer weight (in case of a conversion treatment without chromium).

To produce the sheet according to the invention, the following procedure can be followed, for example.

The installation can comprise a single line or, for example, two different lines for the application of the metallic coatings and the painting respectively. If two different lines are used, they can be located on the same site or in different sites. The following description considers, by way of example, a variant where two separate lines are used.

In a first line for the application of the metallic coatings, a steel substrate is used that is obtained, for example, by hot rolling followed by cold rolling. The substrate is in the form of a strip that is passed through a bath to deposit the metallic coating by hot dipping.

The bath is a molten zinc bath containing from 4.4 to 5.6% by weight aluminum and from 0.3 to 0.56% by weight magnesium. The bath can also contain unavoidable impurities resulting from the process, such as impurities originating from the ingots used to supply the bath, and/or one or more additional elements selected from the group consisting of Si, Ti, Ca, Mn, La, Ce and Bi, wherein the content by weight of each additional element in the metallic coating is less than 0.3%, the presence of nickel being excluded.

The most common unavoidable impurity that results from the passage of the substrate through the bath is iron, which can be present in a content up to 0.8% by weight, generally less than or equal to 0.4% and generally between 0.1 and 0.4% by weight. The unavoidable impurities originating from the ingots used to feed the bath are generally lead (Pb), which is present in a content less than 0.01% by weight, cadmium (Cd), which is present in a content less than 0.005% by weight, and tin (Sn), which is present in a content less than 0.001% by weight. It should be noted here that nickel is not an unavoidable impurity related to the galvanization process.

The bath is at a temperature between 350° C. and 510° C., preferably between 370° C. and 470° C.

After the deposition of the metallic coating, the substrate is wiped, for example, by means of nozzles that project a gas onto both sides of the substrate to adjust the thickness of the coatings. Preferably, the wiping gas comprises neither particles nor solutions such as, for example, those comprising a magnesium phosphate and/or a magnesium silicate. These wiping gas additions modify the solidification of the metallic coating and therefore its microstructure, which would contribute to a degradation of the proper flexibility of the pre-painted sheet according to the invention. In one variant, a brushing can be performed to remove the coating deposited on one face so that only one of the faces of the sheet will ultimately be covered by a coating.

The coatings are then allowed to cool in a controlled manner so that they solidify. The controlled cooling of the coating or of each coating is performed by means of a cooling section or by other appropriate means, and is performed at a rate preferably between 2° C./sec, which corresponds approximately to natural convection, and 35° C./sec between the start of solidification (i.e. when the coating reaches a temperature just below the liquidus temperature) and the end of solidification (i.e. when the coating reaches the solidus temperature). It has been found that cooling rates greater than 35° C./sec do not improve the results any further.

Preferably, the cooling is performed at a rate greater than or equal to 15° C./sec, which contributes to refining the microstructure of the metallic coating and also to preventing the formation on the metallic coating of a spangle visible to the naked eye and that remains visible after painting. More preferably, the cooling rate is between 15 and 35° C./sec.

The strip treated in this manner can then be subjected to a skin-pass step, which work hardens it in order to reduce elasticity, to fix the mechanical characteristics and to give it a roughness appropriate to the stamping operations and the quality of the painted surface that is to be obtained.

The strip can optionally be coiled before being sent to a pre-painting line.

The exterior surfaces of the coatings are subjected there to a surface preparation step. This type of preparation comprises at least one step selected among rinsing, degreasing and a conversion treatment.

The purpose of the rinsing is to eliminate the loose particles of dirt, potential residues of conversion solutions, soaps that may have formed and to achieve a clean and reactive surface.

The purpose of the degreasing is to clean the surface by removing all traces of organic dirt, metallic particles and dust from the surface. This step also makes it possible to alter the aluminum oxide/hydroxide layers and magnesium oxide/hydroxide layers that may be present on the surface of the metallic coating although without otherwise modifying the chemical nature of the surface. An alteration of this type makes it possible to improve the quality of the interface between the metallic coating and the paint film, which improves the corrosion resistance and the adherence of the paint film. Preferably, the degreasing is performed in an alkaline environment. More preferably, the pH of the degreasing solution is between 12 and 13.

The conversion treatment step includes the application to the metallic coating of a conversion solution that reacts chemically with the surface and thereby makes it possible to form conversion layers on the metallic coating. These conversion layers increase the adherence of the paint and the corrosion resistance. The conversion treatment is preferably an acid solution that does not contain chromium. More preferably, the conversion treatment is based on hexafluorotitanic or hexafluorozirconic acid.

The potential degreasing and conversion treatment steps can include other sub-steps of rinsing, drying etc.

Optionally, the surface preparation can also include a step altering the magnesium oxide and magnesium hydroxide layers formed on the surface of the metallic coating. This alteration can consist among other things of the application of an acid solution before the application of the conversion solution, or the application of an acidified conversion solution with a pH between 1 and 5, or also of the application of mechanical forces to the surface.

The painting is performed by the deposition of layers of paint, by means of roll coaters, for example.

Each deposition of a paint layer is generally followed by a curing in a furnace to cross-link the paint and/or to evaporate any solvents and thereby obtain a dry film.

The sheet thus obtained, called a pre-painted sheet, can be recoiled before being cut, optionally shaped and assembled with other sheets or other elements by the users.

To illustrate the invention, tests have been performed that will be described below on the basis of nonrestrictive examples.

Synergy of the ZnAlMg Metallic Coating According to the Invention and of the Paint Film—Decrease in Cracking The propensity to cracking of a ZnAlMg sheet, pre-painted or not, is evaluated as follows:

- a T-bend test is performed on a test piece of a sheet as specified in standard EN13523-7 dated April 2001,
- a section transverse to the bending axis is taken in the thickness of the bend,
- the cross-section of the bend is observed at a high magnification under an optical microscope, and note is taken of:
  - the number of cracks that reach the steel over the entire cross section of the bend,
  - the average width of these cracks (in μm)
  - the sum of the widths of these cracks (in μm)

If necessary, a distinction is made between the cracks in the thickness of the ZnAlMg metallic coating and the cracks in the thickness of the paint film.

A plurality of ZnAlMg sheets having variable compositions were obtained by hot-dip galvanizing a metallic substrate of variable thickness in a molten zinc bath containing magnesium and aluminum followed by a cooling, alternatively under natural convection or at a cooling rate of 30° C./sec. The ZnAlMg sheets were then pre-painted according to the following protocol:

alkaline degreasing, application of the conversion treatment Granodine® 1455 produced by Henkel®, application of a polyester/melamine-type primer layer containing anti-corrosion pigments with a nominal thickness of 5 μm (on dry film), application of a polyester/melamine-type finish layer having a nominal thickness of 20 μm (on dry film).

2T and 3T T-bends were then made both in the bare ZnAlMg sheets as well as in pre-coated sheets, then analyzed.

By way of comparison, 2T and 3T T-bends were also made in bare or pre-painted sheets comprising other types of ZnAlMg coatings.

Tables 1 and 2 summarize the results obtained respectively on bare ZnAlMg sheets and on pre-painted ZnAlMg sheets. The comparison of tables 1 and 2 shows that, very surprisingly, the cracks in the thickness of the ZnAlMg coating according to the invention are significantly less numerous and less wide when the sheet is pre-painted. The combination of a ZnAlMg coating according to the invention and a paint film makes it possible to divide the sum of the crack widths of the metallic coating by a factor of 2.5 to 11; only the ZnAlMg coatings according to the invention exhibit this particularity.

Corrosion Resistance of Pre-Painted ZnAlMg Sheets

The corrosion resistance of pre-painted sheets is evaluated by natural exposure, in compliance with EN13523-19 and EN13523-21, in a class C5-M site on steel that meets the requirements of ISO 12944-2.

The results after one year of natural exposure, which are presented in table 3, show that the ZnAlMg sheets pre-painted according to the invention preserve the advantages of the ZnAlMg coating in terms of corrosion resistance.

TABLE 1

| Test | % by weight Al | % by weight Mg | Coating thickness (μm/face) | Cooling rate (° C./sec) | T-bend | Number of cracks | Average crack width (μm) | Sum of crack widths (μm) |
|---|---|---|---|---|---|---|---|---|
| E1 | 5.0 | 0.5 | 10 | 30 natural convection | 2T | 25 | 4.93 | 123 |
| | | | | | | 26 | 5.22 | 136 |
| | | | | 30 natural convection | 3T | 24 | 4.02 | 97 |
| | | | | | | 16 | 4.25 | 68 |
| E2 | 5.1 | 0.45 | 13 | Unknown | 2T | 24 | 6.42 | 154 |
| | | | | | 3T | 35 | 3.11 | 109 |
| E3 | 4.6 | 0.55 | 14 | Unknown | 2T | 22 | 7.55 | 166 |
| | | | | | 3T | 11 | 7.36 | 81 |
| CE1 | 5.0 | 0.6 | 15 | Unknown | 2T | 19 | 7.79 | 148 |
| | | | | | 3T | 14 | 7.42 | 104 |
| CE2 | 5.0 | 0.69 | 13 | Unknown | 2T | 23 | 6.91 | 159 |
| | | | | | 3T | 22 | 4.13 | 91 |
| CE3 | 1.0 | 1.0 | 16 | Unknown | 2T | 19 | 8.42 | 160 |
| | | | | | 3T | 13 | 6.69 | 87 |
| CE4 | 1.6 | 1.6 | 11 | Unknown | 2T | 18 | 9.17 | 165 |
| | | | | | 3T | 14 | 7.64 | 107 |
| CE5 | 2.3 | 2.3 | 10 | Unknown | 2T | 22 | 8.14 | 179 |
| | | | | | 3T | 17 | 7.29 | 124 |

E = example according to the invention;
CE = counter-example

TABLE 2

| | | | | | | | | Cracks in the metallic coating after painting | | | Cracks in the layer of paint | | |
|---|---|---|---|---|---|---|---|---|---|---|---|---|---|
| Test | % by weight Al | % by weight Mg | Coating thickness (μm/face) | Cooling rate (° C./sec) | Primer paint thickness (μm) | Finish paint thickness (μm) | T-bend | Number of cracks | Average crack width (μm) | Sum of crack widths (μm) | Number of cracks | Average crack width (μm) | Sum of the crack widths (μm) |
| E1 | 5.0 | 0.5 | 10 | 30 natural convection | 5 | 20 | 2T | 8 | 2.46 | 20 | 0 | 0 | 0 |
| | | | | | | | | 5 | 2.6 | 13 | 0 | 0 | 0 |
| | | | | 30 natural convection | | | 3T | 9 | 1.57 | 14 | 0 | 0 | 0 |
| | | | | | | | | 5 | 2.68 | 13 | 0 | 0 | 0 |
| E2 | 5.1 | 0.45 | 13 | Unknown | 5 | 20 | 2T | 4 | 6.73 | 27 | 0 | 0 | 0 |
| | | | | | | | 3T | 5 | 2.60 | 13 | 0 | 0 | 0 |
| E3 | 4.6 | 0.55 | 14 | Unknown | 5 | 15 | 2T | 6 | 4.83 | 29 | 0 | 0 | 0 |
| | | | | | | | 3T | 4 | 7.5 | 30 | 0 | 0 | 0 |
| CE1 | 5.0 | 0.6 | 15 | Unknown | 9 | 18 | 2T | 17 | 6.88 | 117 | 5 | 25.2 | 126 |
| | | | | | | | 3T | 11 | 5.00 | 55 | 0 | 0 | 0 |

TABLE 2-continued

| Test | % by weight Al | % by weight Mg | Coating thickness (μm/face) | Cooling rate (° C./sec) | Primer paint thickness (μm) | Finish paint thickness (μm) | T-bend | Cracks in the metallic coating after painting: Number of cracks | Average crack width (μm) | Sum of crack widths (μm) | Cracks in the layer of paint: Number of cracks | Average crack width (μm) | Sum of the crack widths (μm) |
|---|---|---|---|---|---|---|---|---|---|---|---|---|---|
| CE2 | 5.0 | 0.69 | 13 | Unknown | 6 | 15 | 2T | 18 | 6.10 | 110 | 8 | 19.6 | 157 |
| | | | | | | | 3T | 13 | 4.00 | 52 | 2 | 26 | 52 |
| CE3 | 1.0 | 1.0 | 16 | Unknown | 9 | 13 | 2T | 14 | 9.93 | 139 | 9 | 25.33 | 228 |
| | | | | | | | 3T | 7 | 5.71 | 40 | 6 | 18.33 | 110 |
| CE4 | 1.6 | 1.6 | 11 | Unknown | 5 | 20 | 2T | 16 | 8.56 | 137 | 0 | 0 | 0 |
| | | | | | | | 3T | 11 | 6.73 | 74 | 0 | 0 | 0 |
| CE5 | 2.3 | 2.3 | 10 | Unknown | 7 | 13 | 2T | 21 | 8.57 | 180 | 16 | 14.75 | 236 |
| | | | | | | | 3T | 14 | 7.86 | 110 | 11 | 12.09 | 133 |

E = example according to the invention;
CE = counter-example

TABLE 3

| Test | % by weight Al | % by weight Mg | Coating thickness (μm/face) | Delamination on edge (mm) |
|---|---|---|---|---|
| E1 | 5.0 | 0.5 | 10 | 0.9 |
| CE3 | 1.0 | 1.00 | 16 | 1.1 |
| CE4 | 1.6 | 1.60 | 11 | 1 |
| CE6 | 3.7 | 3.0 | 10 | 1 |

E = example according to the invention; CE = counter-example

What is claimed is:

1. A process for the manufacture of a pre-painted sheet consisting of:

supplying a steel substrate;

depositing a metallic coating on at least one face by hot-dipping the steel substrate in a bath containing:

4.4% to 5.25% by weight aluminum, 0.3% to 0.56% by weight magnesium, 0.0 to less than 0.3% by weight Si, 0.0 to less than 0.3% by weight Ti, 0.0 to less than 0.3% by weight Ca, 0.0 to less than 0.3% by weight Mn, 0.0 to less than 0.3% by weight La, 0.0 to less than 0.3% by weight Ce, 0.0 to less than 0.3% by weight Bi, a remainder of the bath including zinc and unavoidable impurities resulting from the process, the presence of nickel being excluded;

wiping the substrate with a wiping gas:

solidifying the metallic coating, the solidification of the metallic coating taking place at a cooling rate greater than or equal to 15° C./s between the beginning of solidification and the end of solidification of the metallic coating;

optionally skin-pass treating the steel substrate with the metallic coating to provide a roughness;

surface preparation of the metallic coating;

optionally coiling the surface prepared steel substrate with the metallic coating;

painting the metallic coating with a paint film comprising at least one layer of paint comprising at least one polymer selected from the group consisting of melamine cross-linked polyesters, isocyanate cross-linked polyesters, polyurethanes and halogenated derivatives of vinyl polymers, with the exclusion of cataphoretic paints, thereby providing the pre-painted sheet; and optionally recoiling the steel sheet with the metallic coating after the painting;

wherein the paint film has a thickness between 1 and 200 μm, and the metallic coating has a thickness less than or equal to 25 μm.

2. The manufacturing method according to claim 1, wherein the surface prepared steel substrate with the metallic coating is coiled before the surface preparation and the painting.

3. The manufacturing method according to claim 1, wherein the surface preparation includes degreasing in an alkaline environment.

4. The manufacturing method according to claim 3, wherein the pH of the degreasing is between 12 and 13.

5. The manufacturing method according to claim 1, wherein the degreased steel substrate with the metallic coating is subjected to a conversion treatment.

6. The manufacturing method according to claim 5, wherein prior to the conversion treatment and after the degreasing, an acid solution is applied to the metallic coating.

7. The manufacturing process according to claim 1, wherein the metallic coating is free from spangles visible to the naked eye.

8. The manufacturing process according to claim 1, wherein the bath consists of:

4.4% to 5.25% by weight aluminum, 0.3% to 0.56% by weight magnesium, 0.0 to less than 0.3% by weight Si, 0.0 to less than 0.3% by weight Ti, 0.0 to less than 0.3% by weight Ca, 0.0 to less than 0.3% by weight Mn, 0.0 to less than 0.3% by weight La, 0.0 to less than 0.3% by weight Ce, 0.0 to less than 0.3% by weight Bi, a remainder of the bath including zinc and unavoidable impurities resulting from the process, the presence of nickel being excluded.

9. The manufacturing process according to claim 1, wherein the painting is performed by depositing layers of paint by roll coaters.

10. The manufacturing process according to claim 9, the painting includes curing in a furnace to cross-link the paint and/or to evaporate any solvents and thereby obtain a dry paint film.

11. The manufacturing process according to claim 10, wherein the process includes skin-passing the steel substrate with the metallic coating and coiling before painting.

12. The manufacturing process according claim 1, wherein magnesium content of the bath is from 0.3 to 0.55% by weight.

13. The manufacturing process according claim 1, wherein magnesium content of the bath is from 0.44 to 0.56% by weight.

14. The manufacturing process according claim 1, wherein the solidifying is by cooling under natural convection.

15. The manufacturing process according claim 1, wherein paint film is formed by two successive layers of paints.

16. The manufacturing process according claim 15, wherein the two successive layers of paint consist of a primer layer of the melamine cross-linked polyester containing anti-corrosion pigments, and a finish layer of paint of the melamine cross-linked polyester.

17. The manufacturing process according claim 16, wherein the paint film has a thickness between 13 and 20 m, the metallic coating has a thickness between 12 and 20 μm.

18. The manufacturing process according to claim 17, wherein aluminum content of the bath is from 4.6 to 5.1% by weight and magnesium content of the bath is 0.45 to 0.55%.

19. The manufacturing process according to claim 18, wherein a propensity of the metallic coating to cracking is reduced by the paint film, as determined by a T-bend test as defined in standard EN13523-7 dated April 2001, and the propensity of the metallic coating to cracking includes a reduction in an average crack width in the metallic coating.

20. The manufacturing process according to claim 19, wherein the cooling rate is from 15° C./see to 30° C./sec.

21. The manufacturing process of claim 1, wherein the at least one polymer is selected from the group consisting of melamine cross-linked polyesters, isocyanate cross-linked polyesters, and halogenated derivatives of vinyl polymers.

* * * * *